US005802190A

United States Patent [19]

Ferren

[11] Patent Number: 5,802,190

[45] Date of Patent: Sep. 1, 1998

[54] LINEAR SPEAKER ARRAY

[75] Inventor: Bran Ferren, East Hampton, N.Y.

[73] Assignee: The Walt Disney Company, Burbank, Calif.

[21] Appl. No.: 839,324

[22] Filed: Apr. 17, 1997

Related U.S. Application Data

[63] Continuation of Ser. No. 334,627, Nov. 4, 1994, abandoned.

[51] Int. Cl.[6] ..... H04R 25/00

[52] U.S. Cl. ..... 381/182; 381/24; 381/188; 381/82; 381/205; 181/144; 181/196

[58] Field of Search ..... 381/24, 89, 90, 381/154, 156, 159, 182, 186, 188, 199, 205, 82; 181/144, 156, 199

[56] References Cited

U.S. PATENT DOCUMENTS

| | | | |
|---|---|---|---|
| 2,114,680 | 4/1938 | Goldsmith | 381/24 |
| 2,143,175 | 1/1939 | White | 381/24 |
| 2,602,860 | 7/1952 | Doubt | 381/188 |
| 2,927,963 | 3/1960 | Jordan et al. | 381/89 |
| 3,125,181 | 3/1964 | Pawlowski | 381/89 |
| 3,299,206 | 1/1967 | Klepper | 381/155 |
| 3,329,206 | 7/1967 | Klepper | 381/155 |
| 3,393,766 | 7/1968 | Mitchell . | |
| 3,842,203 | 10/1974 | Weisberg | 381/156 |
| 4,223,760 | 9/1980 | Letourneau | 181/147 |
| 4,267,405 | 5/1981 | Russell | 381/24 |
| 4,399,328 | 8/1983 | Franssen et al. | 181/144 |
| 4,524,846 | 6/1985 | Whitby | 181/152 |
| 4,553,628 | 11/1985 | Nakamura | 181/145 |
| 4,625,326 | 11/1986 | Kitzen | 381/63 |
| 4,905,290 | 2/1990 | Yaoita | 381/83 |
| 4,939,688 | 7/1990 | Kitzen | 364/813 |
| 4,940,108 | 7/1990 | Selby | 381/24 |
| 4,965,833 | 10/1990 | McGregor et al. | 381/83 |
| 5,058,169 | 10/1991 | Temmer | 381/188 |
| 5,129,004 | 7/1992 | Imai et al. | 381/86 |
| 5,137,110 | 8/1992 | Bedard, Jr. et al. | 381/154 |
| 5,286,928 | 2/1994 | Borland | 181/153 |
| 5,327,507 | 7/1994 | Suzuki | 381/159 |
| 5,590,214 | 12/1996 | Nakamura | 381/89 |

FOREIGN PATENT DOCUMENTS

| | | | |
|---|---|---|---|
| 0336303 | 10/1989 | European Pat. Off. | 381/159 |
| 3327994 | 2/1985 | Germany | 381/24 |

OTHER PUBLICATIONS

Unbaffled Loudspeaker Column Arrays, by John K. Hilliard, pp. 672 and 673.

J. W. David & Company, Brochure Regarding "Bessel Arrays" 2 pages.

*Primary Examiner*—Paul Loomis
*Assistant Examiner*—Rexford N. Barnie
*Attorney, Agent, or Firm*—Darby & Darby

[57] ABSTRACT

A sound delivery system comprises at least one elongated speaker mounting element. A multiplicity of individual speakers are mounted in the mounting element to form a linear array of speakers with each speaker being adapted to radiate sound in a direction transverse to the array. The number of speakers and the spacing between them are selected so as to focus the sound emanated by the speakers by reducing dispersion of sound in the direction of the linear array. A device is also included for coupling audio signals to the speakers.

7 Claims, 8 Drawing Sheets

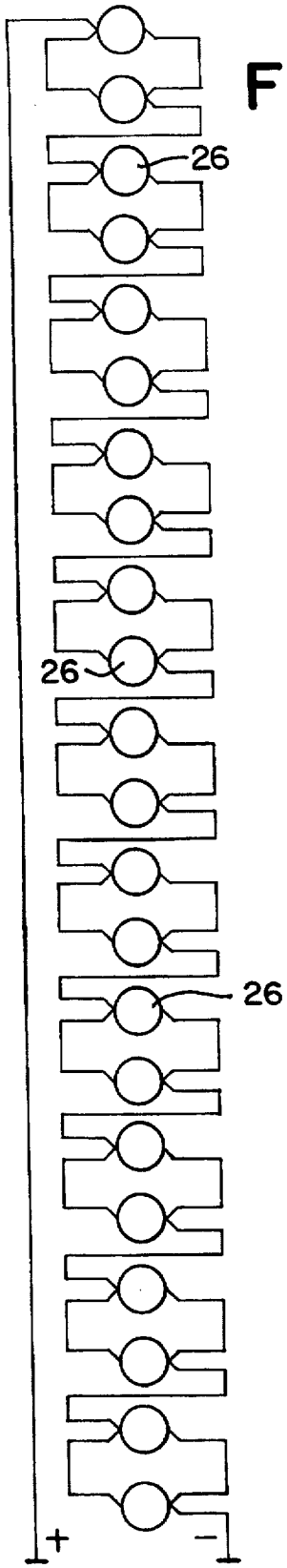
FIG. 12B
FIG. 12C
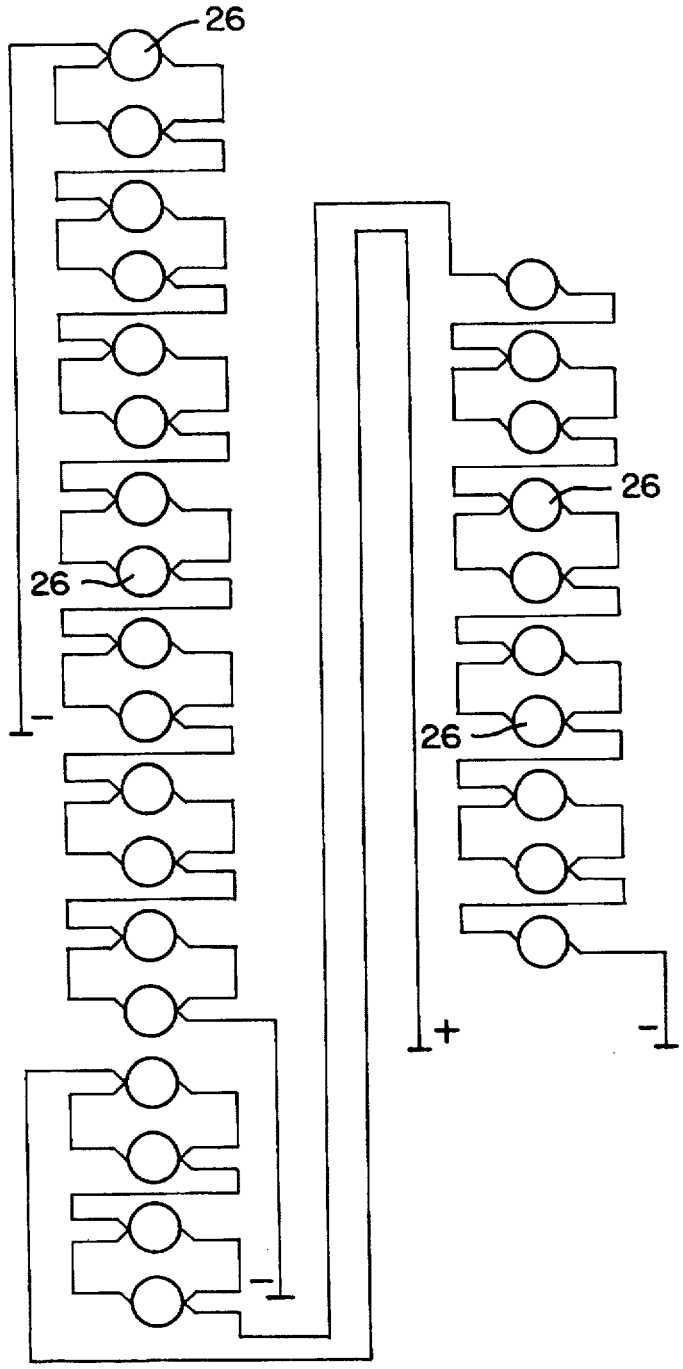

LINEAR SPEAKER ARRAY

This is a continuation, of application Ser. No. 08/334,627, filed Nov. 4, 1994, now abandoned.

This invention relates to audio speaker systems of the type which can be used for sound delivery or reenforcement systems.

BACKGROUND OF THE INVENTION

Sound delivery systems such as public address systems are used in numerous places and situations for making announcements and/or playing background music or the like. When addressing a crowd of people within a large area, such as an indoor concourse or auditorium, echoes generated by the enclosed building create signal output interference within the area. The result is a distorted, sometimes unintelligible or otherwise poor quality audio output signal. To add to the distortion, public address systems commonly use several loudspeakers which are arranged throughout the site and which tend to interfere with each other due to arrival delays.

In a large open area, the power required to project the audio output signal throughout the entire area can result in excessive amplification and potential distortion. Outdoors, it is likely that people close to one of the speakers of the system will be exposed to an uncomfortably high output volume or sound pressure level. This high sound pressure level is necessary so that people remote from the speakers will be able to hear the audio output signal at a normal level.

Further, there has been a growing concern for noise pollution within and around residential areas. Ideally, the audio output from any sound delivery system reaches only those people within a prescribed zone and does not "leak" or escape into the surrounding area. One problem in trying to achieve such an isolated sound delivery system resides in the difficulty of controlling or directing the sound pressure pattern of each speaker or speaker unit of the system. Known sound delivery systems employ speakers which disperse sound in a conical pattern. Because each speaker also requires sufficient power to ensure that all points of a selected area are reached, it is difficult to limit the output sound to a prescribed area.

Another problem with prior art public address systems resides in the manner in which the speakers are normally mounted. In most cases, the individual speakers are placed at the most convenient locations, e.g., on the side of a building, a telephone pole, a lamp post, etc. Typically, these speakers are large, bulky and unsightly. It would be desirable to provide a public address system which discretely integrates the speakers (or speaker arrays) within the environment so that the source of sound is relatively unobtrusive, both visually and audibly.

Moreover, it is common in amusement and theme parks for an individual to address a large group of people through the public address system. If the announcer moves to a position within the vicinity of the loudspeakers, feedback between the loudspeakers and the announcer's microphone generates a high pitched "squeal" which is uncomfortable for the listeners. Electronic means may be provided to reduce the effect of the feedback but this introduces added expense and, furthermore, is not always entirely effective.

The principal objects of this invention are to provide an improved sound delivery system in which the speakers are relatively unobtrusive (i.e. "low profile) and to provide isolated adjacent sound zones".

SUMMARY OF THE INVENTION

Briefly, in accordance with the invention, a multiplicity of individual speakers are mounted in an elongated mounting element, preferably a hollow elongated tube. If a large number of speakers (for example, more than ten) are mounted to form a linear array with minimum spacing between the speakers, the sound energy emanating from the speakers tends to be directed perpendicular to the long axis of the array. Thus, in a public address system, if the speakers are arranged in a vertical array, vertical dispersion of the sound is minimized and the sound can be concentrated in the direction of the listeners.

To minimize the effect of feedback, the speakers may be divided into upper and lower zones with the full frequency range being coupled to the upper zone, but with voice frequencies substantially excluded from the lower zone. Accordingly, if an announcer approaches the speaker array with a microphone, the likelihood of feedback is reduced because the closest speakers (i.e. those speakers in the lower zone) are not producing voice signals. Additionally, because voices tend to have a high frequency, which have an ear-piercing effect on listeners, the voice frequencies are substantially excluded from the lower zone to increase the listener's comfort level.

The invention also has utility in applications other than conventional sound delivery systems. For example, a linear array of speakers may be mounted horizontally above or adjacent to a group of listeners. The speakers can be divided into zones with different audio signals fed to the different zones. Because of the directional or focused nature of a linear speaker array in accordance with the invention, different audio messages can be directed to different groups of listeners beneath the speaker array. This lends itself to various possibilities including the possibility of moving a sound source from one group of speakers to another along the array, possibly in synchronization with listeners moving beneath the speakers.

THE DRAWINGS

FIGS. 12*a*, 12*b* and 12*c* show a representative wiring diagram for connecting the speakers of an individual array.

DETAILED DESCRIPTION

As used herein, the term "sound delivery" is not limited to any specific application. Although the invention was designed for use in situations where audio programs are directed to the public at large, the ultimate use of a linear speaker array is not a feature of the invention.

Figure 1:
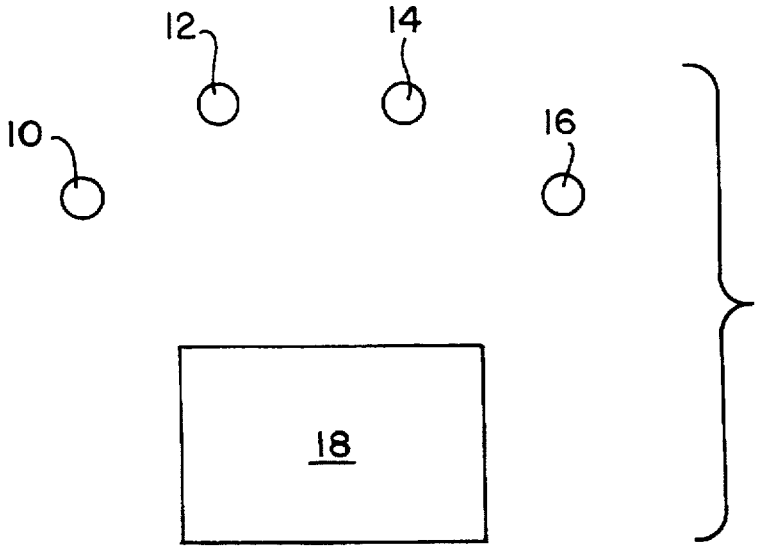
FIG. 1 is simplified diagrammatic illustration showing how four linear speaker arrays may be arranged for use as a public address system.

FIG. 1 shows schematically a typical public address environment in which linear speaker arrays in accordance with the invention may be used. Four speaker arrays 10, 12, 14 and 16 are illustrated. These arrays will direct sound toward a location designated by numeral 18 which may contain a multitude of listeners. For a stereophonic or multichannel effects, speaker arrays 10 and 12 may broadcast a "left" or channel 1 sound channel and FIGS. 14 and 16 a "right" or channel 2 sound channel.

Very often in theme and amusement parks, the listeners will be addressed by an announcer with a microphone who, for one reason or another, will walk back and forth in front of his or her audience, at times approaching any one of the speaker arrays. If the speakers are generating voice signals, as the announcer approaches the speaker, positive feedback will occur and an unpleasant squeal will emanate from the speakers. In accordance with one aspect of the invention, and as explained below, high frequencies may be eliminated from the signals fed to those speakers (i.e., the lower speakers) which are most likely to be approached by the announcer to prevent feedback which has frequently caused listener discomfort in previous systems.

The preferred embodiment of the invention is shown in FIGS. 2–5. The speakers are mounted on an elongated mounting element comprising a hollow tube 20 having a flat mounting surface 22 containing apertures 24 (FIG. 5) in which respective individual speakers 26 are mounted. Mounting holes (not numbered) around each aperture 24 enable the speakers to be secured to the mounting surface 22 by conventional fastening means. In the preferred embodiment, the tubular mounting element 20 is an aluminum extrusion having the cross-section shown in FIGS. 3–5.

Each of the speakers 26 may be identical and, for example, comprise a four inch mid-range speaker having a mounting flange 30 so that the speaker can be fastened to the mounting surface 22. The fastening means for securing the individual speakers to the mounting surface are not shown in the drawings.

Two channels 27 are located at the intersection of the circular rear wall portion of the extension and the mounting surface 22. The channels 27 extend the length of the extrusion and are shaped to receive the edges of a front protective screen 28. The protective screen 28 covers and protects the speakers 26 and, in the preferred embodiment, serves an aesthetic purpose in that it gives the entire array a cylindrical shape. Thus, when the arrays are spaced, for example as shown in FIG. 1, they appear as unobtrusive or even themed poles in contrast to the unsightly loudspeakers of standard public address systems.

Figure 2:
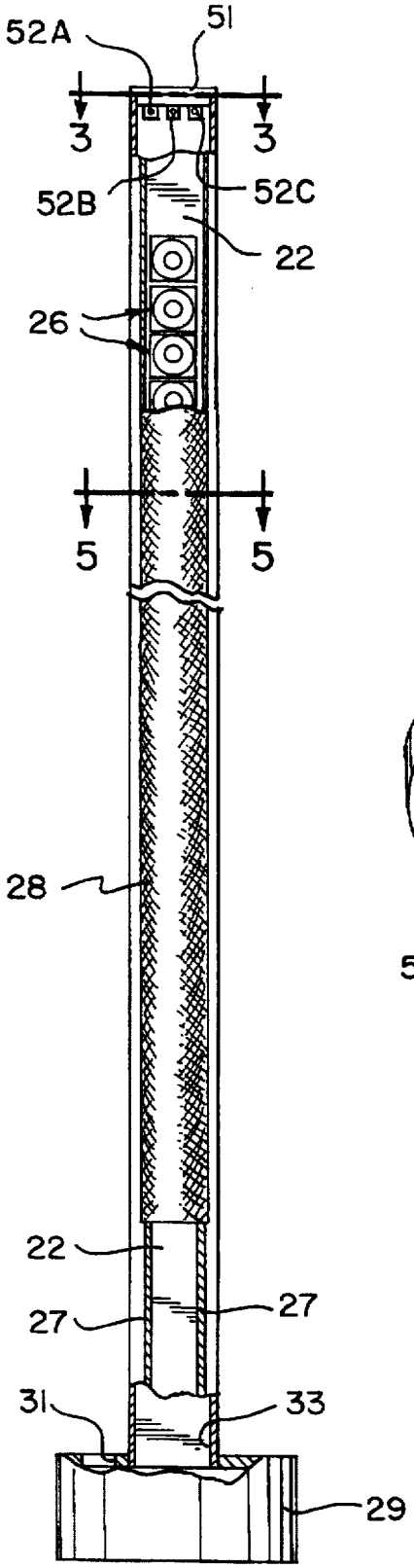
FIG. 2 is a front plan view partially in section showing a vertical linear speaker array in accordance with a preferred embodiment of the invention.
Figure 4:
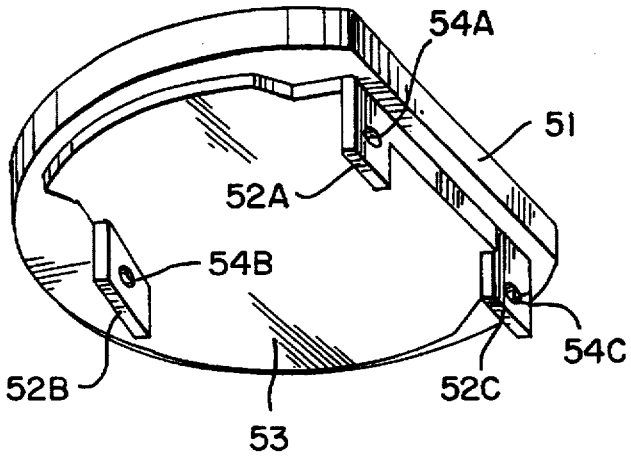
FIG. 4 is a bottom perspective view of a cover plate that can be used to seal the top of the column which supports the array.

Because the individual speakers are relatively small, it may be desirable to enhance the bass response by the use of separate subwoofers (not shown). In accordance with one additional feature of the invention, the column of speakers may be mounted on a base which functions as a tuned resonator at low frequencies (e.g. below 100 hz) to enhance low frequency response. As shown in FIG. 2, the tuned resonator may comprise a closed cylinder 29 having a circular port 31 in its upper surface. The cylindrical base 29 includes an opening 33 in which the column of speakers is mounted. The column is open at its lower end so that the speakers drive the base, the dimensions of which are selected so as to enhance low frequency response. As one example, in the case of the four inch speakers mounted in a column six inches in diameter, the inner dimensions of the base 29 may be 17.5 inches in diameter and 8 inches in height. The port 31 may have a 3 inch diameter.

Because it is preferred to have the listeners disposed within the acoustical energy emanating from the vertical array of speakers 26, speaker height is important and the speakers are disposed such that they should at least span the range of ear heights of any potential group of listeners. Accordingly, in the embodiment of the invention, the speakers are disposed between a 3 foot height and an 8 foot height because a child would require a minimum height of about 3 feet and an adult may require up to about 8 feet.

Figure 3:
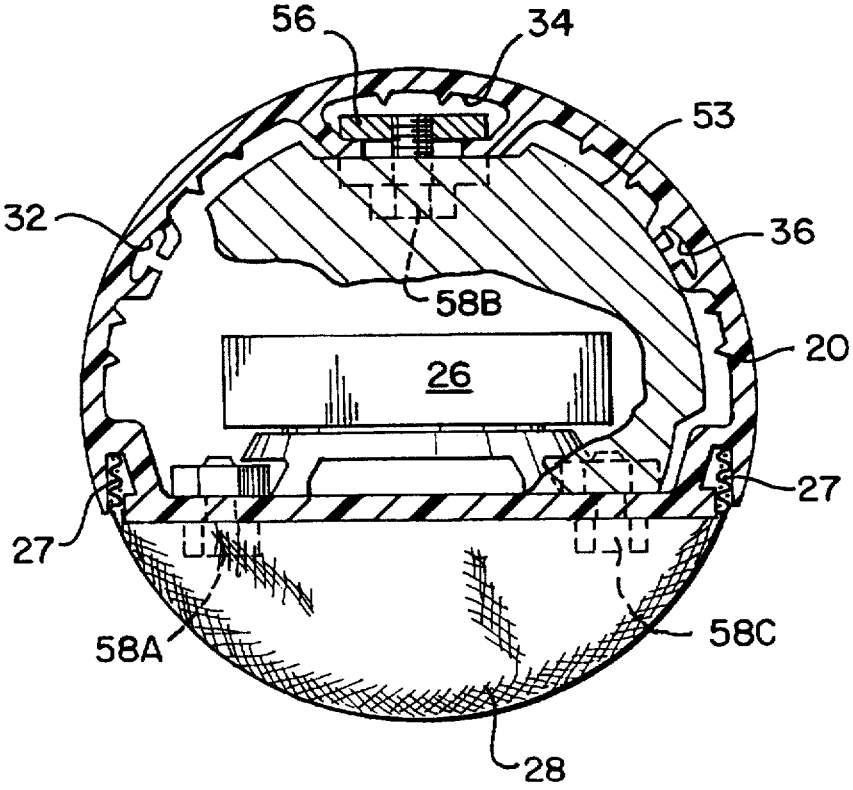
FIG. 3 is a sectional view along the line 3—3 of FIG. 2.
Figure 5:
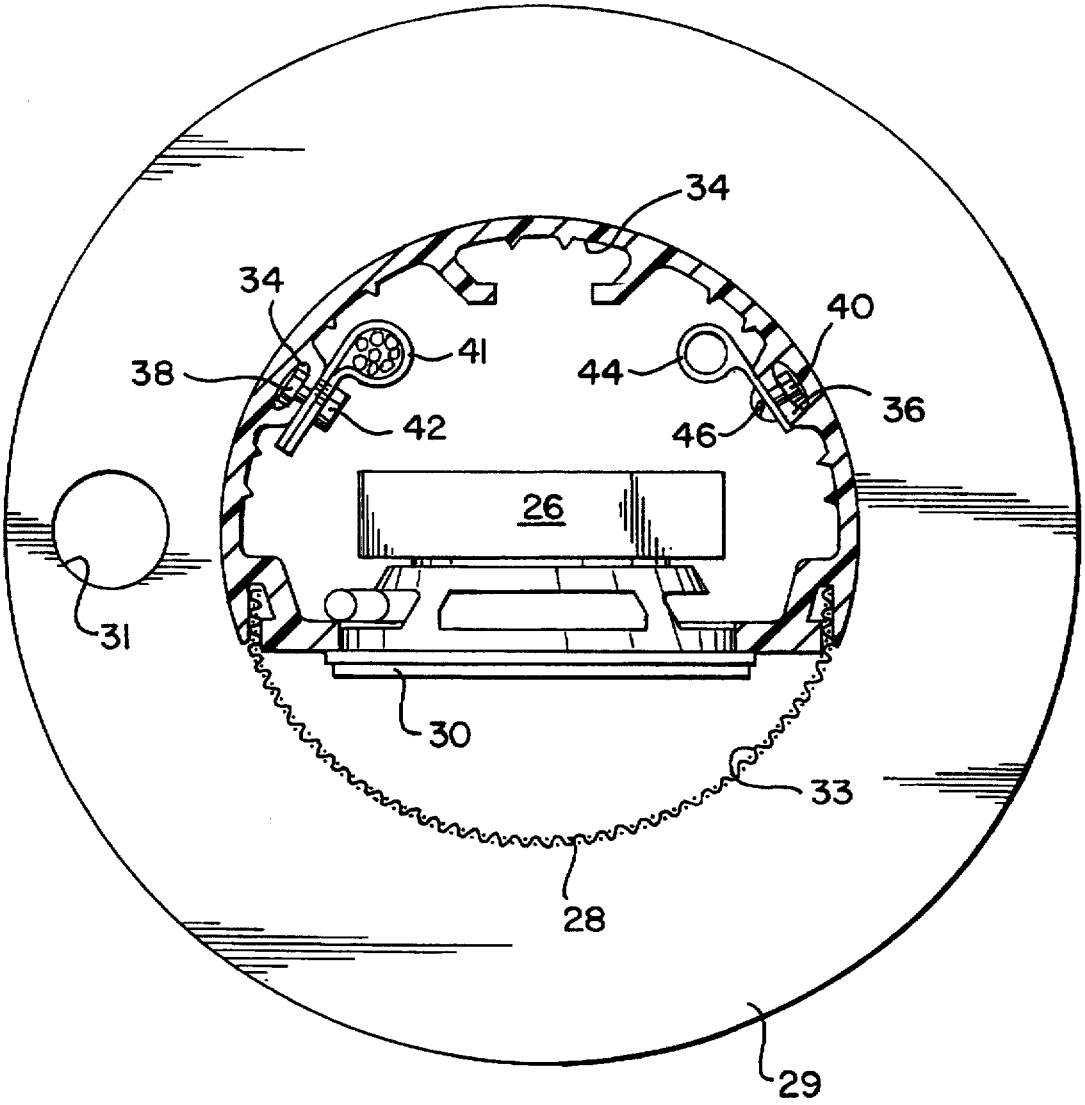
FIG. 5 is a sectional view along the line 5—5 of FIG. 2.

The use of an extrusion is beneficial from a mechanical viewpoint. As shown in FIGS. 3 and 5, the extrusion includes internal grooves 32, 34 and 36. The grooves 32 and 36 are adapted to receive "slip in" nuts 38 and 40 (FIG. 5), respectively, for the purpose of securing clips within the extrusion which function to guide wires or cables through the length of the extrusion. For example, a wire clip 41 may be secured to the nut 38 by means of a bolt 42. The wires for the individual speakers would be retained by the clips 41 which, for example, may be spaced every two or three feet.

To avoid complexity, the wires to the individual loud speakers are not shown in FIGS. 1–5 although, for purposes of explanation, speaker wires are illustrated within the clip 41. The wires from all of the speakers are directed to the base of the array so that they can be easily coupled to the driving amplifiers in any of a number of different combinations. If groups of speakers are "ganged" together, then a single pair of wires for that group is required.

When an elongated hollow tube is used as the mounting member for the speakers, it can also function to support other structural elements. For example, lamps may be mounted on top of the extrusion to create a visual display in conjunction with the audio program being delivered by the public address system. In such a case, a few vertically separated clips 44 may be attached to the nuts 40 by means of bolts 46 and used to direct the cables required to power the lamps at the top of the extrusion.

The column may be air tight. For this purpose, an end cap 51 is provided having a mounting plate 53 which includes three tabs 52 A, B and C each of which includes a respective aperture 54 A, B and C. An end plate mount 56 (FIG. 3) is placed within the extrusion groove 34. The end cap 51 is secured by means of bolt 58B which passes through the tab 52B into the end plate mount 56. Tabs 52A and 52C may be secured by bolts 58A and 58C which pass through suitable apertures within the mounting surface 22 of the extrusion. Gaskets (not shown) may be used at each of the speaker apertures and at the top of the extrusion to ensure that the column is air tight.

Figure 6:
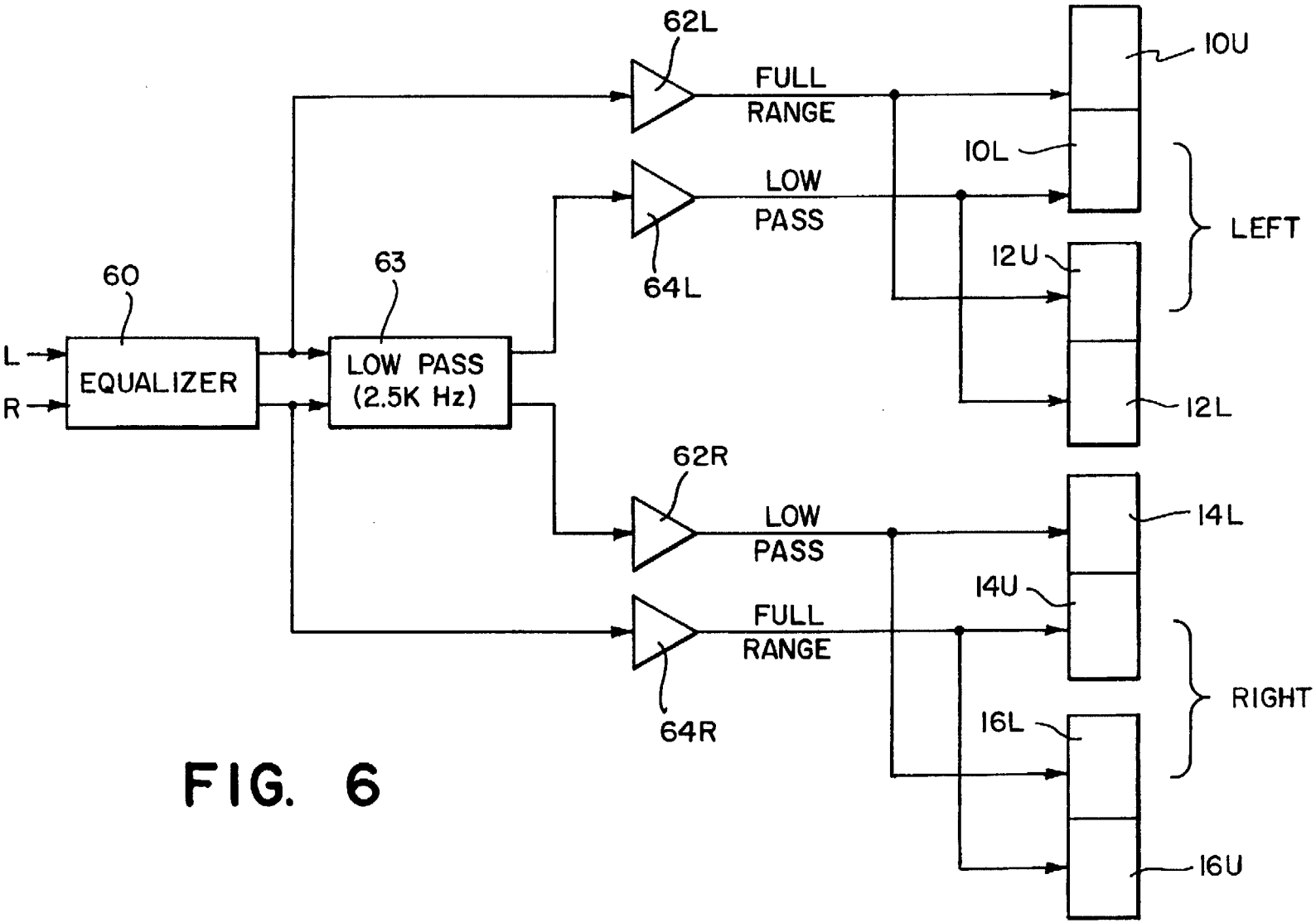
FIG. 6 is a schematic illustration of a system which can be used to drive four vertical arrays as shown in FIGS. 2–5.

FIG. 6 shows in schematic form a circuit which may be used to drive the individual speaker arrays. In FIG. 6 each speaker array is shown as being separated into upper and lower zones which are designated by the letters U and L, respectively. If, for example, each individual column is about twelve feet high, thirty four-inch full-range speakers may be mounted in the column. The upper zone may consist of the fifteen upper speakers and the lower zone the fifteen lower speakers.

As shown in FIG. 6, left and right stereo signals L and R, respectively, are fed to an equalizer 60. The outputs from equalizer 60 are fed to power amplifiers 62R and 62L which provide full range signals to drive the upper speaker zones 10U and 12U (for the left stereo signal), and 14U and 16U (for the right signal). The equalizer outputs are also fed to a low pass filter 63 which, for example, may have a crossover frequency of 560 Hz. These low frequency signals are fed to power amplifiers 64R and 64L which in turn drive the speakers in the lower zones 10L, 12L, 14L and 16L.

As indicated above, because the lower speakers of the array do not broadcast a substantial portion of the voice frequency band, the tendency for feedback is reduced when a person with a microphone approaches the array. This reduction in feedback may also be due to the fact that most of the sound coming from the speaker array is coming from speakers other than the one at which the microphone is directed. In any event, whatever the reason, experience has shown that microphones can come closer to a linear array of speakers without causing uncomfortable feedback than is possible with single speaker loudspeaker systems of the type commonly used for public address systems.

There are other benefits to separating the array into upper and lower zones. Because the high frequencies are not fed to the lower speakers, the sound is more comfortable for listeners who are close to the array. Also, when the arrays are to be equalized in the absence of an audience, the fact that the lower speakers do not broadcast high frequencies more closely simulates the conditions that exist when a crowd surrounds the arrays, in which case the high frequencies tend to be absorbed by the audience.

The number of speakers in a linear array is not critical and is generally a function of the sound level desired from the array. To enhance directionality, the speakers in an array should be located as close as possible. In one embodiment, thirty four-inch full-range Pyle speakers were mounted on a twelve foot long extrusion. The diameter of the extrusion was about six inches, the spacing between adjacent speakers being one-half inch. The center of the lowermost speaker was 8.5 inches above the bottom of the extrusion. Satisfactory results have also been achieved with speaker arrays consisting of ten and twenty closely spaced speakers.

Figure 11:
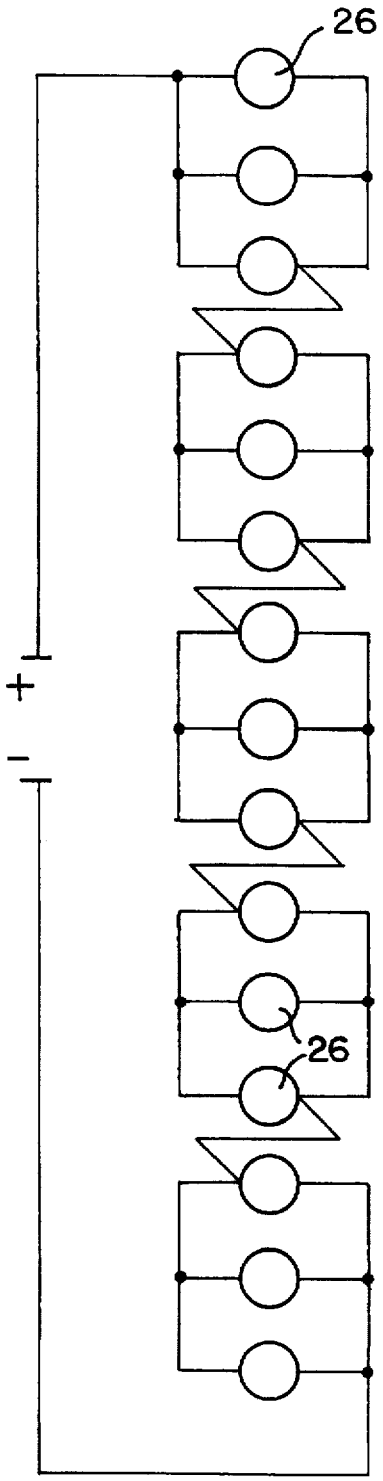
FIG. 11 shows a representative wiring diagram for connecting the speakers of an individual array.
Figure 12A:
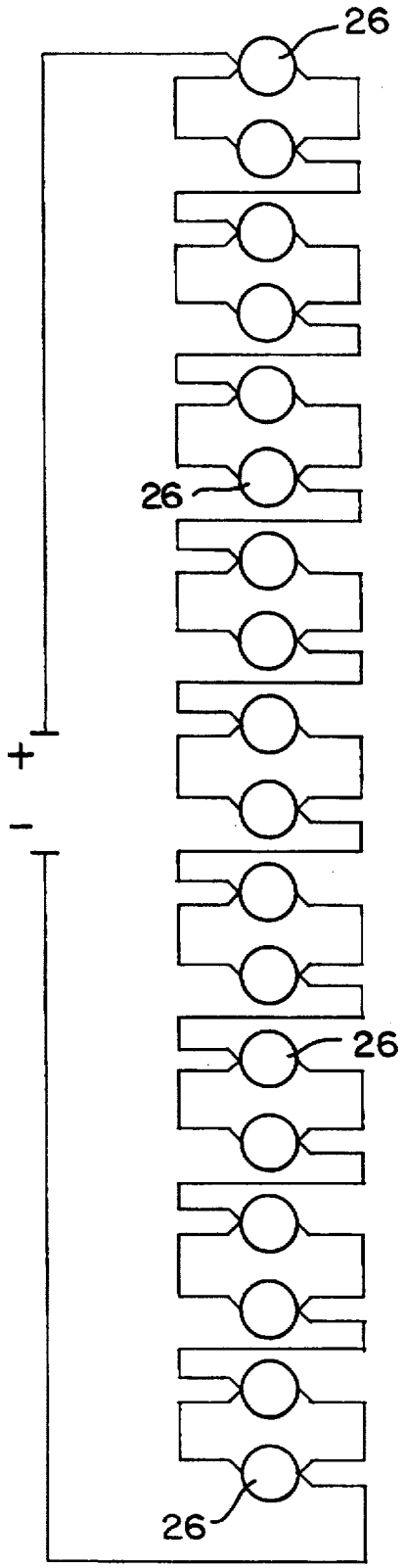

The individual speakers can be connected in many different ways depending on the resistance of the speakers and amplifier power. For example, in the case of one ohm speakers, the speakers of each set of fifteen may be connected in a series parallel relationship as shown in FIG. 11. In this case, the impedance across the combined fifteen speakers is 3.5 ohms DC resistance. Alternate wiring diagrams for arrays containing eighteen, twenty-two and twenty-eight speakers are shown in FIGS. 12*a*, 12*b*, and 12*c*, respectively.

In most conventional public address systems, a single relatively powerful speaker (or speaker system) is used with a great deal of acoustic energy being radiated from essentially a single source. The invention differs from such systems by applying a multiplicity of small low power speakers each of which radiates relatively little energy. However, the sound energy radiated by the individual speakers reinforces each other with the result that a more directional or focused acoustic pattern is developed in the direction of the array. The greatest reinforcement occurs in the center of the array where a great deal of power exists; since each of the individual speakers produces relatively low power, the acoustical energy radiated in undesired directions by the speakers at the end of the array is low.

Some degree of control over the direction of the sound can be obtained by changing the phase of the signals fed to the individual speakers. To adjust the phase of individual speakers (or groups of speakers), the speakers (or groups thereof) must be separately driven. With individual networks at each speaker, the array can be optimized using known phased array techniques.

The Horizontal Array

Figure 7:
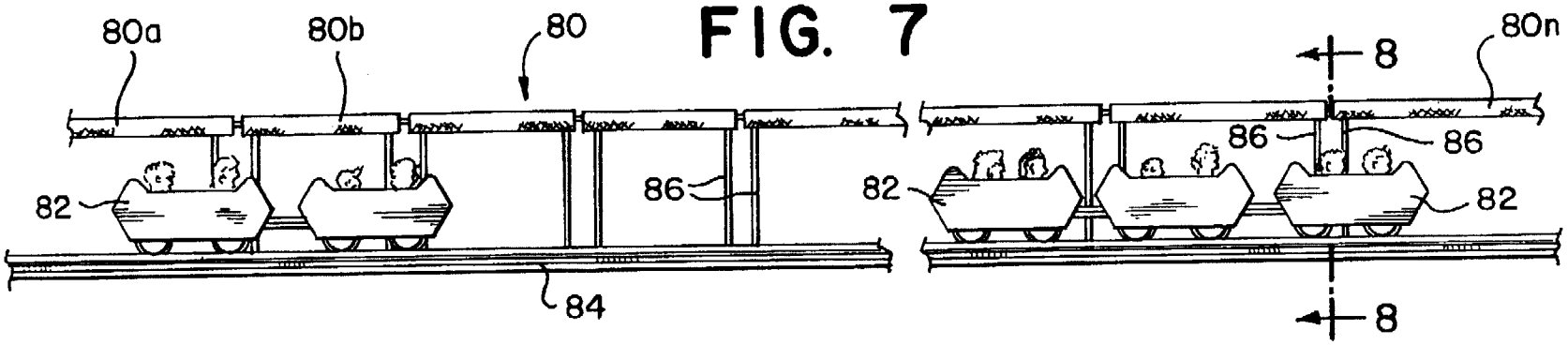
FIG. 7 is a diagrammatic illustration showing how a large number of linear speaker arrays in accordance with the invention may be disposed horizontally for the purpose of providing an audio program to a representative group of listeners moving beneath the array.
Figure 9A:
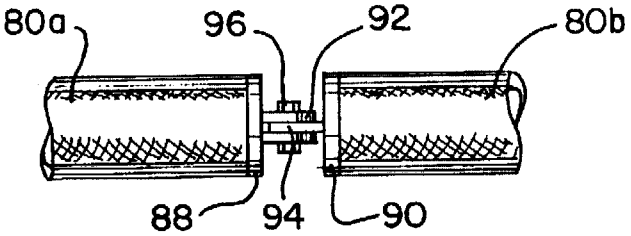
FIG. 9A is a front view of the junction between two adjacent horizontal linear arrays showing one way for coupling two arrays together.
Figure 9B:
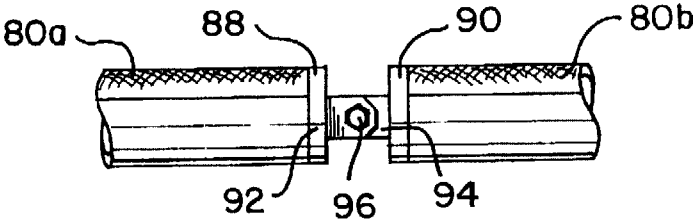
FIG. 9B is a top view of the junction shown in FIG. 9A.
Figure 8:
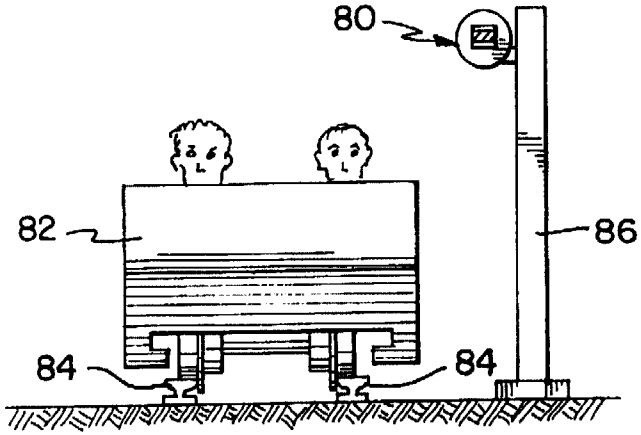
FIG. 8 is a front view along the line 8—8 of FIG. 7.

As mentioned above, a linear array of speakers in accordance with the invention may be disposed vertically or horizontally. FIG. 7 shows in diagrammatic form an extended linear speaker array 80 comprising a multiplicity of individual arrays 80*a*, 80*b*. . . 80*n*, each of which may be identical to the linear speaker arrays 10, 12, 14 and 16 of FIGS. 1–5. In FIG. 7, the horizontal array 80 is shown disposed above groups of carts 82 of the type which are often found in amusement parks and theme parks. The carts run on tracks 84 and the linear array 80 is mounted on stanchions 86 which, of course, form no part of this invention.

Each of the individual linear arrays 80*a*, 80*b*. . . 80*n* is a closed column having end plates 88 and 90 at opposite ends which may be secured to the extruded support columns as described above with respect to FIGS. 3, 4 and 5. The end plate 88 includes a bifurcated lug 92 and the end plate 90 includes a mating lug 94 so that the individual arrays may be secured together by conventional fastener means 96, e.g. nuts and bolts.

In this example, the individual carts and their occupants travel along the tracks 84 beneath the linear horizontal array 80. If background music or the like is being broadcast through all of the speakers in array 80, then all of the occupants of the carts 82 hear the same audio program. However, in accordance with the invention wherein a multiplicity of small full-range speakers are closely mounted, the arrays are highly directional so that it is possible to broadcast a first program to the occupants of one car and a different program to the occupants of a second cart, even an adjacent one. This leads to a number of possibilities, including the ability to move an audio program in synchronism with the movement of the cart. For example, it is possible to broadcast an audio program in one language to the occupants of one cart and in a different language to the occupants of another cart. In accordance with a further feature of the invention, the individual speakers within the horizontal array 80 are coupled to a driving circuit in such a way that it is possible for the occupants of different cars to hear different audio programs as they traverse the path beneath the array.

Figure 10:
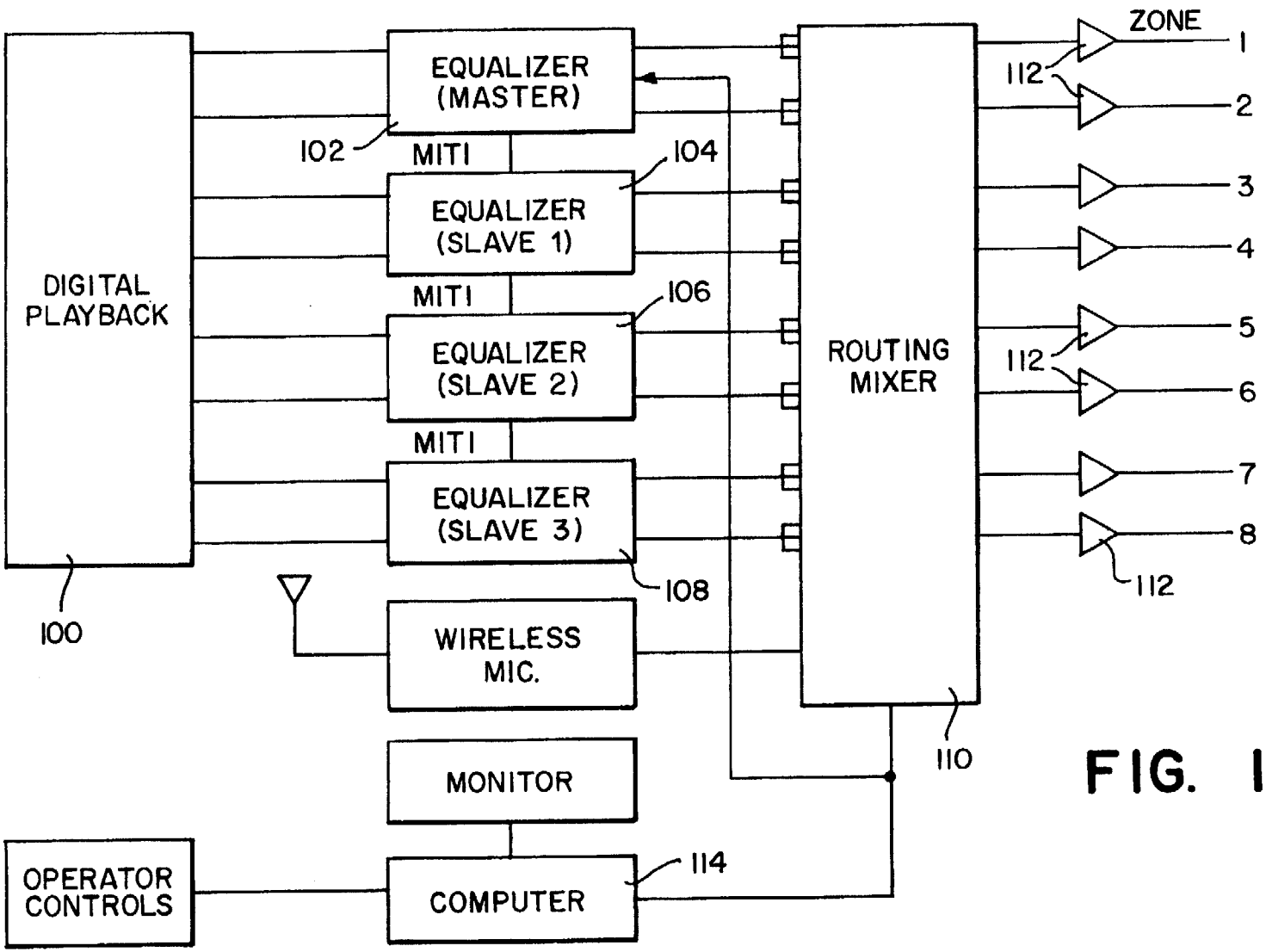
FIG. 10 is a schematic illustration of a circuit that can be used to provide a multiplicity of different audio programs to the horizontal array.

FIG. 10 shows in schematic form a preferred embodiment for controlling an elongated linear array of speakers of the type shown in FIG. 7. For purposes of explanation, the linear array may be considered to consist of eight separate zones referred to as Zone 1 through Zone 8. Each zone may consist of fifteen adjacent speakers. Each array 80*a*, 80*b*, etc. may contain thirty speakers or two zones.

The audio programs which are to be broadcast to the listeners in the various zones may be recorded on a digital audio recorder 100 (Fostex RD-8). By way of example, the audio programs may include background music which is to be broadcast across the entire array, a male voice and a female voice. For the sake of explanation, it is assumed that the male and female voices are to move from zone to zone in synchronism with a group of listeners moving beneath the array.

The audio outputs from the recorder 100 are fed to a series of audio equalizers which include a master equalizer 102

(FCS 926) and slave equalizers 104, 106 and 108 (FCS 920). The master equalizer 102 is programmable and adjusts the signal level in a predetermined way to create a desired audio effect insofar as the listeners are concerned. For example, if the listeners were moving from an indoor environment to an outdoor environment, as the audio was shifted from the indoor speakers to the outdoor speakers, the signals would be equalized so that the listeners would not be aware of any change in sound that might be due to a change in the environment.

The equalizer outputs are coupled to a routing mixer 110 (SAS) which couples the signals at its input to one of eight power amplifiers 112 (Crown MACROTEC 1200) which drive the speakers in the individual Zones 1 through 8. The routing mixer 110 is controlled by a computer 114 which, among other things, determines which of the input sources is to be fed to which speaker zone at any given time. The computer 114 may also control the sound level and the phase.

The speaker zones may consist of any desired number of speakers and it is not necessary that the speakers in a given zone be contiguous. For example, if a stereophonic effect is desired, a single zone may comprise every second or third speaker. It is possible also that each individual speaker be separately controlled. This would enable precise control of the movement of a particular audio program along the array.

There are many different applications for a horizontal array of speakers. Two other currently contemplated uses are as follows.

In amusement and theme parks, customers may often have to wait in long lines for a ride or other attraction. If a horizontal array of speakers extended over the entire line, different audio messages could be delivered to the waiting guests as they move along the line. Different announcements, for example, or different audio programs could be presented at different positions within the line to ease the guest's wait.

As should be apparent from the foregoing description, the term "horizontal" is not intended to imply that the speakers are horizontal with respect to ground. As used herein, the term "horizontal" is intended to characterize an array of speakers which is disposed adjacent a path traversed by one or more listeners or speakers.

I claim:

1. A public address sound delivery system, comprising at least one elongated speaker mounting element;

a multiplicity of individual speakers mounted in said mounting element to form a vertical linear array of speakers with each speaker adapted to radiate sound in a direction transverse to the array, the number of speakers and the spacing between them being selected so as to focus the sound emanated by the speakers by reducing dispersion of sound in the direction of the linear array; and means for coupling audio signals containing voice signals to said speakers, said means including means for separating the audio signals into at least a first signal containing said voice signals and a second signal in which a substantial part of said voice signals is not present, said first signal being connected to an upper group of speakers and said second signal being connected to an entire lower group of speakers whereby the likelihood of positive feedback between a microphone in proximity to said lower group of speakers and said lower group of speakers is substantially reduced.

2. A sound delivery speaker system according to claim 1 wherein said array comprises at least ten speakers.

3. A sound delivery speaker system according to claim 1 wherein said array comprises at least twenty speakers.

4. A sound delivery speaker system according to claim 1 wherein said array comprises at least thirty speakers.

5. A sound delivery speaker system according to claim 4, wherein said hollow tube is mounted on a base containing a space, the size of which is selected to enhance low frequency audio signals when the speakers are driven.

6. A public address sound delivery system according to claim 1, wherein said elongated speaker mounting element comprises a hollow tubular member.

7. A public address sound delivery system according to claim 6, wherein said hollow tubular member is extruded.

* * * * *